US005407303A

United States Patent [19]

Manns

[11] Patent Number: 5,407,303

[45] Date of Patent: Apr. 18, 1995

[54] REINFORCED SOIL STRUCTURES OF REINFORCED EARTH TYPE

[76] Inventor: Jose E. R. Manns, 158 Edgar Theotonio Santana, Sao Paulo-SP, Brazil

[21] Appl. No.: 32,795

[22] Filed: Mar. 17, 1993

[30] Foreign Application Priority Data

Apr. 2, 1992 [BR] Brazil ..... 9201334
Mar. 4, 1993 [BR] Brazil ..... 9300805

[51] Int. Cl.[6] ..... E02D 29/02
[52] U.S. Cl. ..... 405/262; 405/286
[58] Field of Search ..... 405/258, 262, 284, 285, 405/286, 287, 287.1

[56] References Cited

U.S. PATENT DOCUMENTS

| | | | |
|---|---|---|---|
| 1,762,343 | 6/1930 | Munster | 405/262 |
| 3,490,242 | 1/1970 | Schnabel | 405/262 |
| 4,069,677 | 1/1978 | Yamada et al. | 405/262 X |
| 4,329,089 | 5/1982 | Hilfiker et al. | 405/262 |
| 4,564,316 | 1/1986 | Hunziker | 405/262 |
| 4,834,584 | 5/1989 | Hilkiker | 405/262 |
| 4,952,098 | 8/1990 | Grayson et al. | 405/262 |

*Primary Examiner*—David H. Corbin
*Attorney, Agent, or Firm*—Irving M. Weiner; Joseph P. Carrier; Pamela S. Burt

[57] ABSTRACT

Invention Patent concerning an "IMPROVEMENT TO REINFORCED SOIL STRUCTURES OF REINFORCED EARTH TYPE", formed through the association of: embankment soil 1 to an inner reinforced structure 2, which become limited by an outer, flexible embankment limiter made of concrete 3, and formed by premolded reinforced concrete panels 6. On inner faces of the embankment limiter are fixed, by means of joint elements 4, elements 5 constituting the reinforced structure 2. The elements 5 each including a high carbon steel individual bar 7 with a corrugated or grooved surface, and having mounted thereon, through pressing a plurality of anchorage discs 8 made of steel which is more ductil than of the bar. The discs are placed at regular and orthogonal intervals with relation to said steel bar 7, and the rear end of the bar has mounted thereon, through pressing, a joint element 4 which is adapted to be joined to corresponding outer facing 3 concrete panel 6.

18 Claims, 1 Drawing Sheet

REINFORCED SOIL STRUCTURES OF REINFORCED EARTH TYPE

BACKGROUND

1. Field of the Invention

The present patent has as its object, reinforced soil structures of reinforced earth type, comprised in the field of civil engineering, which have been improved to provide a better performance, easier execution and being cheaper than conventional ones.

Discussion of Relevant Art

It has already been disclosed a construction technology for abutment walls utilizing Reinforced soil structures also called "Reinforced Earth", which essential element consists of an association of soil embankment with an inner reinforcement structure, which are confined by an outer, flexible concrete made facing which acts as an embankment limiter, with the reinforcement structure fixed to an inner face thereof.

Accordingly, in a more detailed way, the embankment soil must have suitable properties, and the reinforcement structure constituted by enough number of metallic, flat and flexible elements, which are suitably positioned with relation to each other on layers, as they are constructed, and the rear ends of said reinforcements are fixed to the outer facing, which is formed by reinforced concrete premolded panels coupled to each other through groove and tongue embedding.

The inventor of this method for construction of abutment walls is Henry Vidal, who uses rectangular galvanized metallic strips of 3.0×38.0 up to 5.0×60.0 mm cross section which are provided on both faces with transverse corrugation measuring about 2.0–3.0 mm height and being separated from each other with an average distance of 8.0 cm and acting as anchorage element between the soil and strips.

Despite the efficiency of reinforcement elements in the form of corrugated strips, as above mentioned, said strips are fabricated specially for this use, thus giving reasons for a relatively higher cost, which fact is not always acceptable considering the cost/ideal benefit of certain works.

In California, in the late 70's there were introduced reinforced soil embanking walls provided with reinforcement structure in the shape of welded mesh. Each mesh is formed by four or more longitudinal, parallel steel bars with diameters from 10 mm to 14 mm whereupon are assembled through welding, transverse bars presenting the same diameter and being positioned at intervals of 30 cm or 60 cm. The connection of said meshes to concrete facings is achieved through a galvanized welded loop connector, which is the object of a patent issued in 1988, still in force.

That embodiment of reinforced structure elements, presents, as an advantage over previous corrugated strips, the fact that they are obtainable from materials commonly used in civil engineering that is, steel bars which are suitably worked, such as by welding, for obtaining the mesh, thus resulting in less cost for said reinforced structure.

Moreover, the ratio weight/efficiency of reinforcement structures obtained from said meshes is more economic than those presented by structures of corrugated strips.

Despite said advantages presented by the mesh over the corrugated strips, some drawbacks are still observed and it is desirable to overcome same. Tests have shown that about 80% of the resistance against slipping of the mesh is given by transverse bars whose faces directed toward the horizontal stress tighten or compress the earth, thus providing passive resistance.

However, other tests have shown that such welded transverse bars present bendings or distortions due to great earth pressures, thus easing the slippage of longitudinal bars and consequently jeopardizing the work.

Another drawback concerning the use of mesh relates to the fact that the transverse bars welded on the surface of longitudinal bars provide an asymmetrical set which, when subjected to earth pressures acting more intensely on transverse bars, as already seen, causes a bending momentum on longitudinal bars thus causing the reduction of about 7% concerning useful resistance thereof.

Besides, in order to make the welding easier, the bars utilized for meshing or grading must have an even surface, that is, without corrugations, on their surfaces, such as the corrugations which are commonly made nowadays on reinforced concrete bars. These corrugations are useful to improve the coefficient of friction, of the longitudinal bars with the soil.

On the other hand, in order to achieve proper a welding without weakening of constituent bars of the mesh, the bars have to include a lower carbon content, that is at most up to 0.4%. This lower carbon content weakens the resistance of the steel.

Another drawback the mesh shaped reinforced structure element relates to its large dimension and weight, which makes the handling thereof difficult, specially concerning the operation of galvanization.

SUMMARY OF THE INVENTION

In view of above drawbacks and with the purpose of overcomming same, structures have been proposed according to the present invention in which the longitudinal corrugated strips on the welded mesh are replaced by individual, parallel, corrugated round bars of high carbon content, like those used in reinforced concrete structures, provided with a series of pressed discs, orthogonal to the bar, and positioned at regular distances. The steel of these discs is of low carbon content, more malleable than the bar itself so as to penetrate inside the corrugations or grooves of the much harder bar. This fact is very important because it hinders a sliding of the disc along the bar.

The rear end of said bar connects a corresponding reinforced threaded coupling sleeve assembled through pressing to the bar, which sleeve houses one of the ends of a threaded bolt and the other end of said bolt being threaded on a similar sleeve assembled through pressing on a hook, and the hook and similar sleeve being formed integrally into the reinforced concrete panel of the facing.

The present reinforced structure element is obtained from material of common usage in civil engineering, being commonly found in the market, which fact causes a sensible reduction of costs, mainly with relation to corrugated flat strips.

Tests have shown that the anchorage provided by the corrugation of the round bars and orthogonal pressed discs on them, which is the object of present patent, is more efficient than that achieved through flat strips with transverse bars of common mesh.

Moreover, the orthogonal pressed plates and longitudinal bars whereupon they are mounted, define a symmetrical set, in such way that the stress of the discs on the bar is centered and does not cause bending moments, which would otherwise reduce the resistance of said bar.

Another advantage of present invention utilizing bars with discs, particulary in comparison with the mesh, is that the absence of welding permits the bars to be constructed with steel of high contents of carbon, with considerably higher resistance than the steel with less percentage of carbon (C=0.04%) necessary to weld mesh shaped elements, CA-50.

Tests show that most of the resistence of the present bars with discs is provided by the anchorage of these discs in the earth.

Such aspect, together with the fact that the bars are totally independent from each other, allow that said bars can be used in minimum necessary quantities to comply with the project, that is, it allows an accurate dimensioning of reinforced structure for a certain abutment wall.

The above mentioned advantage does not occur in practice with welded grating reinforced structures, which, for purposes of easing the control of stocks, are normally standardized. The fact of such standardization causes the frequent utilization of meshes with excessive number of bars, due to lack of intermediate models which would be suitable for each different case.

The drawings attached hereto shows the improvement to reinforced soil structures of reinforced earth type, which is the object of present patent, wherein.

Figure 3A:
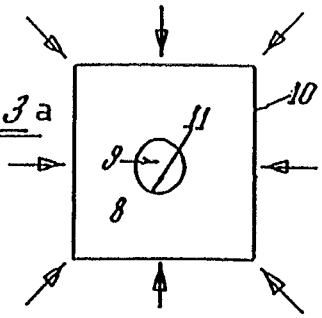
Figure 3B:
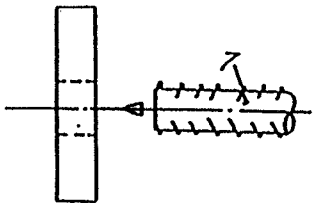

FIG. 3*a* is a front elevational view of an anchorage plate according to its original shape, before being pressed on steel bar; FIG. 3*b* is a side view of FIG. 3*a;*

Figure 4A:
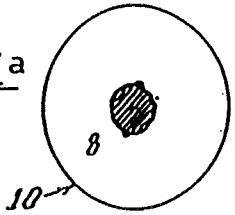
Figure 4B:
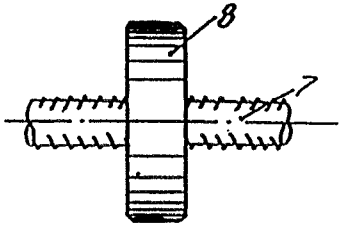
Figure 2:
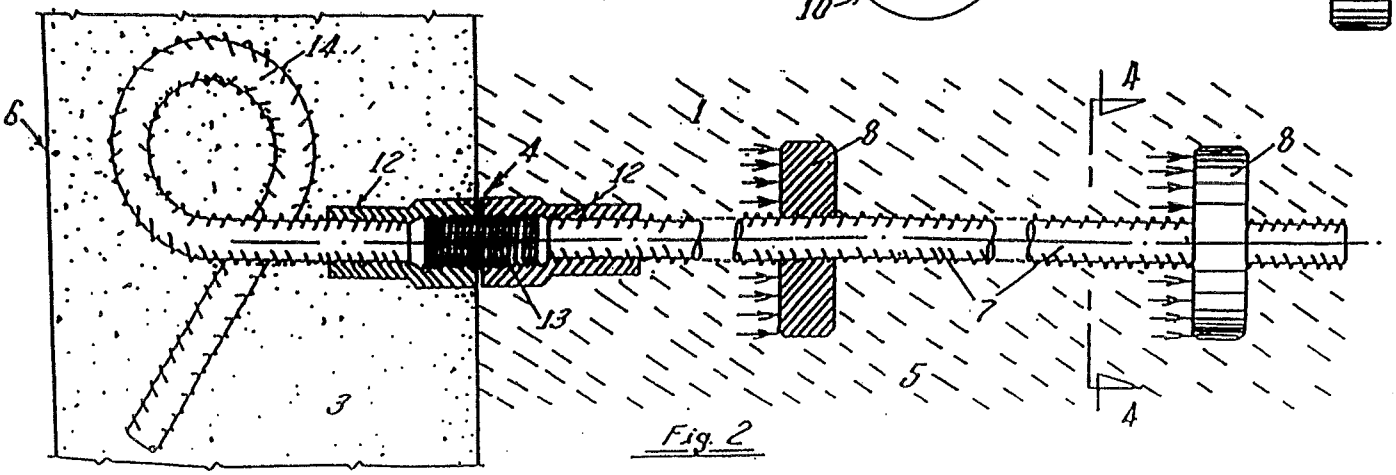
FIG. 2 shows one reinforced structure element which is an integral part of the reinforced soil structure of FIG. 1, shown alone and with partial sections for a better understanding.

FIG. 4*a* shows a cut 4—4 shown in FIG. 2, depicting the anchorage plate after it has been pressed onto the steel bar; FIG. 4*b* is a side view of FIG. 4*a*.

DETAILED DESCRIPTION OF A PREFERRED EMBODIMENT

Figure 1:
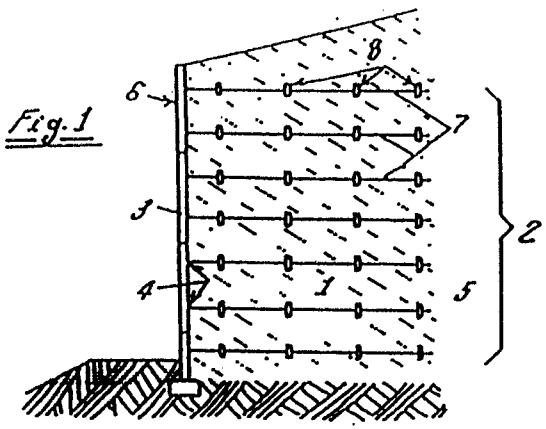
FIG. 1 is a plan view of a reinforced soil structure according to the invention.

According to what is depicted in above figures, the reinforced soil structure (FIG. 1), intended to house the reinforced structure which is the object of present invention, is of reinforced earth or soil type and is formed by the association of: embankment soil 1 to an inner reinforced structure 2, which are limited by an outer, flexible facing made of concrete 3. The flexible facing 3, or embankment limiter, has joint elements 4 on an inner surface thereof, and elements 5 of the reinforced structure 2 are fixed to the concrete facing through the joint elements 4. Reinforced structure 2 comprises a plurality of horizontal parallel and flexible steel bars 7, the specific number of which is determined according to the project. The bars 7 are positioned at suitable intervals with relation to each other, on embankment layers, as they are constructed, and the rear ends of said reinforced structure elements 5 are fixed by the joint elements 4 to a respective panel 6 which is part of the outer, flexible facing made of concrete 3. Said outer, flexible facing made of concrete 3, is formed by panels 6 which are made of reinforced concrete, premolded and presenting characteristics which are suitable to provide a hinged coupling with relation to each other.

In this present improvement, each element of reinforced structure 5 (FIG. 2) comprises an individual steel bar 7 having assembled through pressing, a plurality of orthogonal steel discs 8 thereon, the disc being positioned at regular spaces with relation to the steel bar 7, and the bar is joined to a corresponding concrete panel 6 of outer facing 3, through joint element 4. In a more detailed way, each individual steel bar 7 is made of high carbon steel with a corrugated or grooved surface.

Each anchorage disc 8 is obtained by pressing a very ductile steel plate of low carbon content such as 0.1% carbon onto the bar 7. The ductile steel plate is provided with a central hole 9, originally of larger diameter than the bar 7 so that it may be easily slipped over and along the bar before it is pressed thereon.

The discs 8 thus pressed are mounted on bar 7 at intervals as determined in the project, generally (but not necessarily) between 70 and 150 cm, and are fixed to said bar through radial pressing applied to outer edges 10 of said discs, by means of a suitable device, in such a way that corrugations of the bar penetrate the softer material of disc providing a strong joint, between the parts, without the utilization of the other fastening means, such as welding.

Slipping tests of anchorage discs 8 on bar 7, interconnected through pressing, as above described, resulted in average stresses from 9000 kg to 10000 kg, to make the panel slide longitudinally over a bar 7 of 12.5 mm diameter.

The joint element 4 is preferably formed by a threaded sleeve 12 mounted through pressing to the rear end of bar 7, said sleeve housing one of the ends of a threaded bolt 13, presenting a diamenter sensibly larger than the bar 7, and the other end whereon is threaded a second equal sleeve 12' mounted through pressing on a hook 14. The hook and said second sleeve 12' being inside the premolded reinforced concrete panel 6 of outer facing 3.

It is obvious that the entire dimensioning of the reinforced structure 2, besides above mentioned measures, is planned according to each specific case. Additionally, all reinforced structure parts, that is: joint 4, steel bar 7 and anchoring discs 8 are submitted to galvanizing treatment to face working conditions.

Although there has been what is at present considered to be the preferred embodiment of the invention, it will be understood that the invention can be embodied in other specific forms without departing from the spirit or essential characteristics thereof. The present embodiment is, therefore, to be considered in all aspects as illustrative and not restrictive. The scope of the invention is indicated by the appended claims rather than by the foregoing description.

I claim:

1. An inner reinforcing structure in a reinforced earth type reinforced soil structure formed through the association of embankment soil, the inner reinforcing structure disposed relative to the embankment soil, and a flexible embankment limiter made substantially of concrete panels defining a limit of the reinforced soil structure, said inner reinforcing structure comprising:

a plurality of individual reinforcing elements; and means for separately fixing each of said individual reinforcing elements to the embankment limiter;

each of said individual reinforcing elements including a steel bar with a high carbon content and having a corrugated outer surface, and a plurality of anchorage elements fixed onto said steel bar in a spaced pattern therealong, said anchorage elements projecting radially outwardly from said steel bar, and said anchorage elements being made of steel which is more ductile than that of said bar.

2. An inner reinforcing structure according to claim 1, wherein said securing means includes a first joint element provided at an end of each of said steel bars, and a plurality of second joint elements fixed to a surface of said embankment limiter facing said inner reinforcing structure and adapted to be joined together with said first joint elements.

3. An inner reinforcing structure according to claim 2, wherein said second joint elements are disposed along said surface in a spaced pattern specifically determined according to the overall dimensions of a soil structure being reinforced.

4. An inner reinforcing structure according to claim 1, wherein each said anchorage element comprises a disc having a central aperture through which a corresponding one of said steel bars extends, said discs being pressed onto said bars such that surfaces of said discs defining said apertures are distorted to lockingly engage corrugations defined in the corrugated outer surfaces of said steel bars.

5. An inner reinforcing structure according to claim 1, wherein said securing means includes a plurality of first threaded sleeves fixed to ends of said steel bars, respectively, a plurality of second threaded sleeves fixed to a surface of said embankment limiter facing said inner reinforcing structure, and a plurality of threaded bolts adapted to have opposite ends thereof threadedly received by said first and second threaded sleeves, respectively.

6. An inner reinforcing structure according to claim 5, wherein said bolts have a diameter which is sensibly larger than that of said steel bars.

7. An inner reinforcing structure according to claim 5, wherein said securing means further includes a plurality of hook elements having said second threaded sleeves fixed thereto, respectively, said hook elements and said second threaded sleeves being integrally molded into said embankment limiter.

8. An inner reinforcing structure according to claim 5, wherein said first threaded sleeves are pressed onto said ends of said steel bars.

9. An inner reinforcing structure according to claim 5, wherein said first and second threaded sleeves are identical.

10. A reinforced soil structure, comprising:

an inner reinforcing structure adapted to be embedded substantially within an earthen embankment; and a flexible embankment limiter made substantially of concrete panels;

said inner reinforcing structure includes a plurality of individual reinforcing elements, and means for separately fixing each of said individual reinforcing elements to said embankment limiter;

each of said individual reinforcing elements includes a steel bar with a high carbon content, and a plurality of anchorage elements fixed onto said steel bar in a spaced pattern therealong, said anchorage elements projecting radially outwardly from said steel bar, and said anchorage elements being made of steel which is more ductile than that of said steel bar.

11. A reinforced soil structure as recited in claim 10, wherein:

said fixing means includes a first joint element provided at an end of each of said steel bars, and a plurality of second joint elements fixed to a surface of said embankment limiter facing said inner reinforcing structure and adapted to be joined together with said first joint elements.

12. A reinforced soil structure as recited in claim 11, wherein:

said second joint elements are disposed along said surface in a spaced pattern; and a number of said steel bars and said first and second joint elements used is specifically determined according to the overall dimensions of said earthen embankment being reinforced.

13. A reinforced soil structure as recited in claim 10, wherein:

each of said steel bars of said inner reinforcing structure includes a corrugated outer surface; and each of said anchorage elements comprises a disc having a central aperture through which a corresponding one of said steel bars is inserted, said discs being pressed onto said steel bars such that surfaces of said discs defining said aperture are distorted to lockingly engage with said corrugations of said steel bars.

14. A reinforced soil structure as recited in claim 10, wherein:

said fixing means includes a plurality of first threaded sleeves adapted to be fixed to an end of each of said steel bars, a plurality of second threaded sleeves adapted to be fixed to a surface of said embankment limiter facing said inner reinforcing structure, and a plurality of threaded bolts adapted to have opposite ends thereof threadingly received by said first and second threaded sleeves, respectively.

15. A reinforced soil structure as recited in claim 14, wherein:

said bolts have a diameter which is sensibly larger than that of said steel bars.

16. A reinforced soil structure as recited in claim 14, wherein:

said fixing means further includes a plurality of hook members having said second threaded sleeves fixed thereto, respectively, said hook members and said second threaded sleeves being integrally molded into said embankment limiter.

17. A reinforced soil structure as recited in claim 14, wherein:

said first threaded sleeves are pressed onto said ends of said steel bars.

18. A reinforced soil structure as recited in claim 14, wherein:

said first and second threaded sleeves are identical.

* * * * *